US005559680A

United States Patent [19]

Tabanera

[11] Patent Number: 5,559,680

[45] Date of Patent: Sep. 24, 1996

[54] ELECTROLUMINESCENT BICYCLE HELMET

[76] Inventor: Dennis A. Tabanera, 228 Willowdale Rd., Morgantown, W. Va. 26505

[21] Appl. No.: 419,797

[22] Filed: Apr. 11, 1995

[51] Int. Cl.[6] ..... F21L 15/14

[52] U.S. Cl. ..... 362/106; 362/72; 362/84

[58] Field of Search ..... 362/84, 103, 105, 362/106, 72, 806

[56] References Cited

U.S. PATENT DOCUMENTS

| | | | |
|---|---|---|---|
| 4,231,079 | 10/1980 | Heminover | 362/106 |
| 4,319,308 | 3/1982 | Ippoliti et al. | 362/106 |
| 5,111,366 | 5/1992 | Rife et al. | 362/31 |
| 5,327,587 | 7/1994 | Hurwitz | 362/105 X |
| 5,469,342 | 11/1995 | Chien | 362/84 |

FOREIGN PATENT DOCUMENTS 0166534 1/1986 European Pat. Off. .

*Primary Examiner*—Stephen F. Husar
*Attorney, Agent, or Firm*—Spencer D. Conrad

[57] ABSTRACT

A bicycle helmet is provided having (a) a structural foam liner, (b) a plastic shell overlay the liner and having a transparent zone and an opaque zone, (c) an electroluminescent lamp film located between the liner and the shell and positioned to emit light from the transparent window, (d) a battery and (e) an inverter. The battery and inverter are housed in pockets on opposite sides (left, right) of the helmet for providing a weight balanced helmet. The battery is an electrical communication with the inverter for supplying direct current thereto. The inverter converts the direct current to alternating current and is in electrical communication with the film for causing light to be emitted therefrom. The cover units for the pockets are preferably shaped for desirable aerodynamic, structural and aethestic properties.

7 Claims, 4 Drawing Sheets

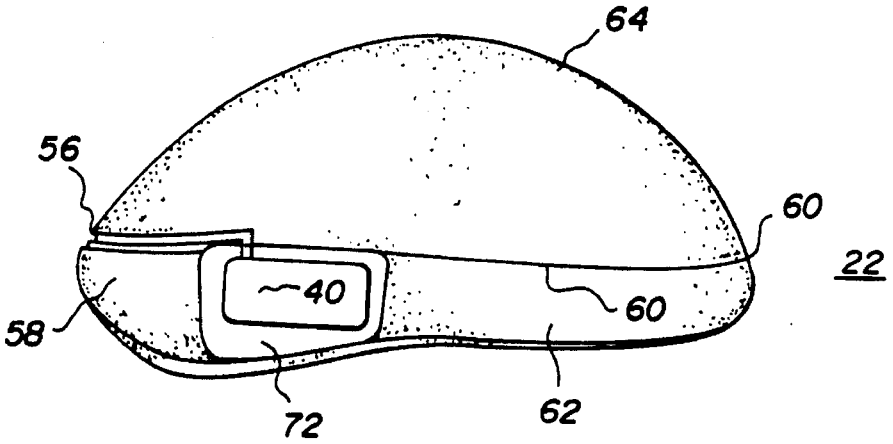
FIG. 10
FIG. 8
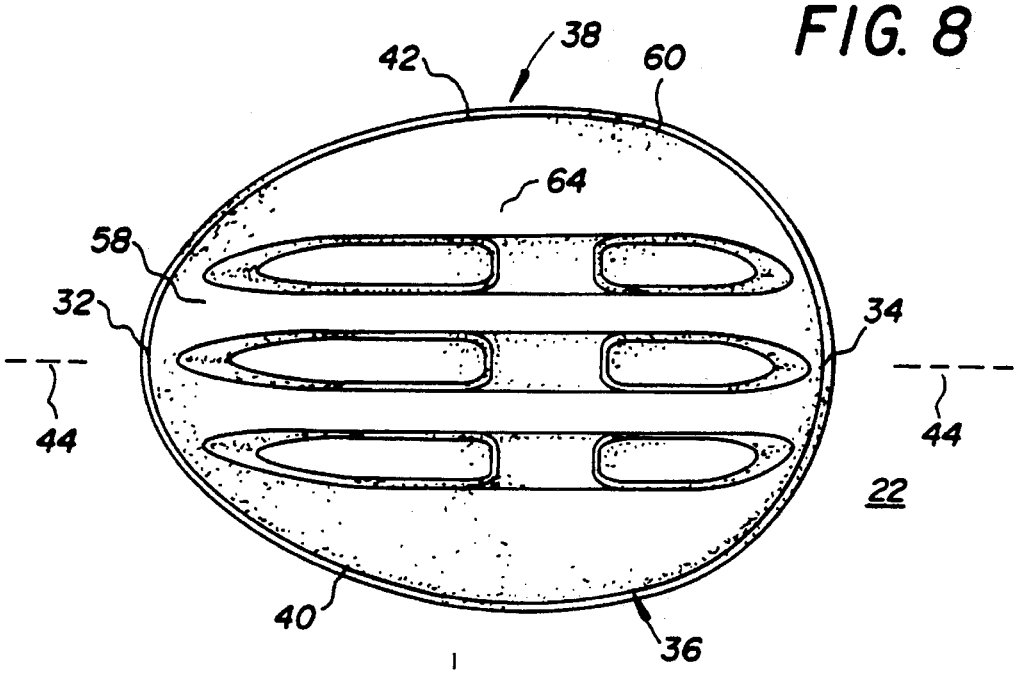
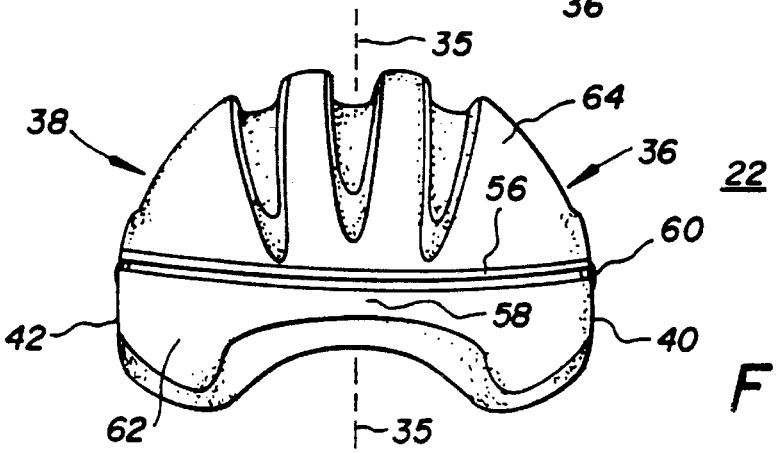
FIG. 9

ELECTROLUMINESCENT BICYCLE HELMET

BACKGROUND OF THE INVENTION

1. Field of the Invention

The present invention relates to illuminated bicycle helmets, and more particularly relates to electroluminescent bicycle helmets.

2. Description of the Related Art

Electroluminescent bicycle helmets are known, Hurwitz, U.S. Pat. No. 5,327,587, issued Jul. 12, 1994. The helmet of Hurwitz, however, utilized a single compartment 12*a* for receiving a power unit 10 which included a rechargeable battery 10*a* and an inverter 10*b*. The power unit 10 was positioned on the right rear of the helmet shell 5. As shown in FIG. 3 of Hurwitz, the electroluminescent strip 4 was adhered to the outside of the shell 5. Additionally, the compartment 12*a* was formed under the helmet shell 5 thereby requiring the cutting away of a portion of the shell 5. The lopsided positioning of the unitary power unit undesirably causes an imbalance in the load of the helmet which can be uncomfortable for cyclists. The positioning of the electroluminescent strip on the exterior of the helmet exposes the film to undesirable environmental elements such as abrasions during crashes and use. The cutting away of the shell undesirably reduces the graphic and design visual impact achievable by a complete shell.

Consequently, there is a need for an electroluminescent helmet which exhibits weight load balance, a protected electroluminescent film and/or a complete (hole-free) helmet shell.

SUMMARY OF THE INVENTION

The present invention involves an electroluminescent bicycle helmet comprising (a) a structural foam liner, (b) a battery, (c) an inverter, (d) an electroluminescent lamp film and (e) a helmet shell. The foam liner is symmetrical about a vertical plane running from the front of the helmet to the back of the helmet, and correspondingly, the helmet has a left side half and a right side half wherein the left half and right half are integral with each other. Each half of the liner has a pocket wherein the pockets are located in symmetrical positions relative to the plane. The battery is located in one pocket and the inverter is located in the other pocket for providing a helmet balanced about the above reference vertical plane.

BRIEF DESCRIPTION OF DRAWINGS

FIG. 8 is a top plan view of the liner of FIG. 1, FIG. 9 is a rear elevational view of the liner of FIG. 1, and FIG. 10 is a side elevational view of the liner of FIG. 1.

DETAILED DESCRIPTION OF THE INVENTION

Figure 1:
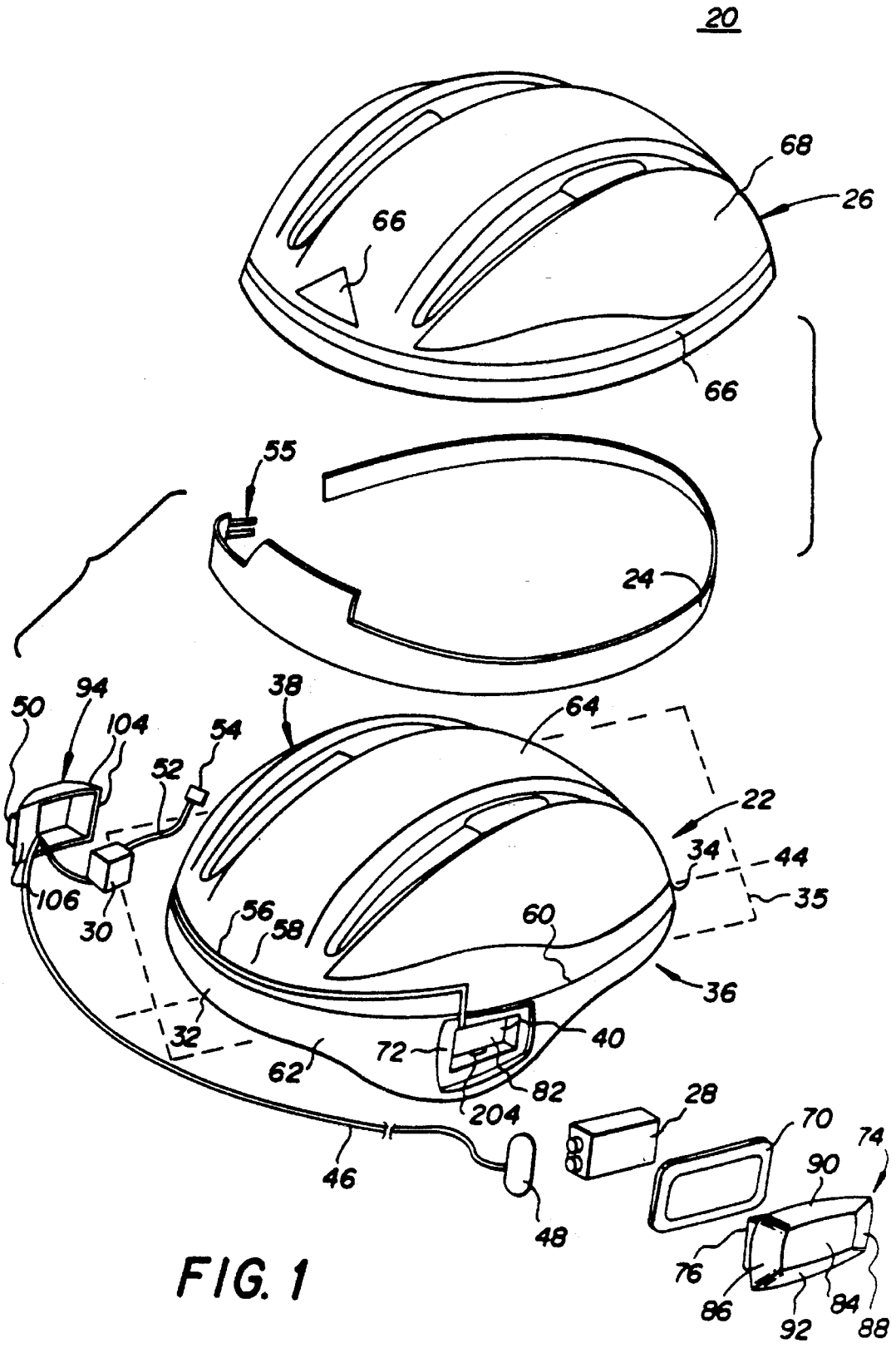
FIG. 1 is an exploded perspective view of a helmet according to the present invention.
Figure 3:
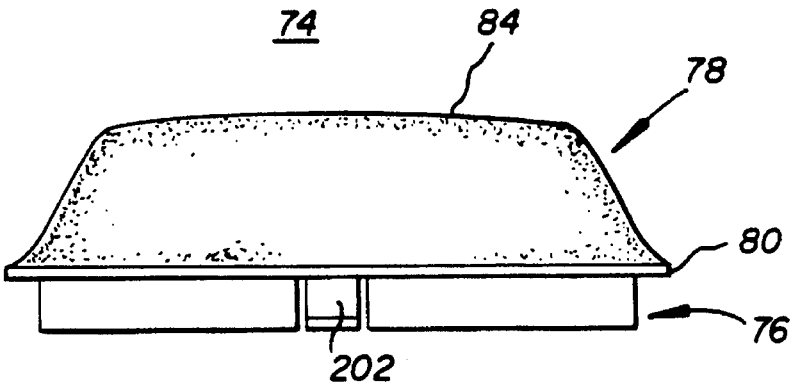
FIG. 3 is a bottom plan view of the power housing unit of FIG. 2.
Figure 2:
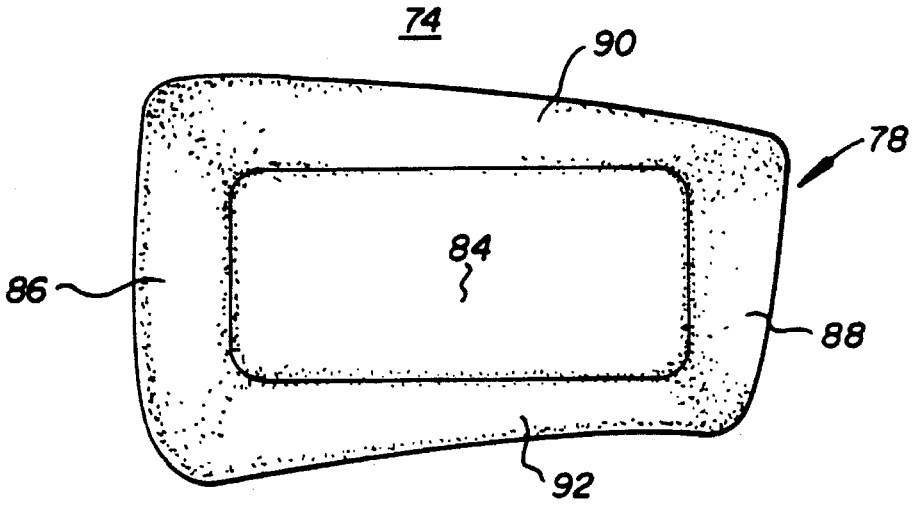
FIG. 2 is a side elevational view of a power housing unit of FIG. 1.
Figure 4:
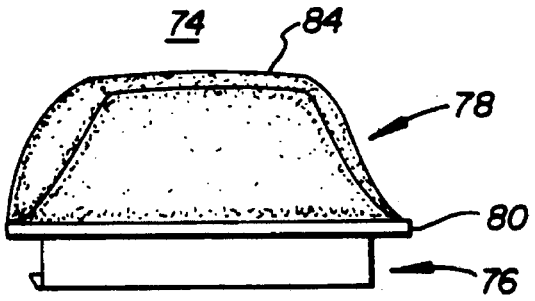
FIG. 4 is a rear elevational view of the power housing unit of FIG. 2.
Figure 5:
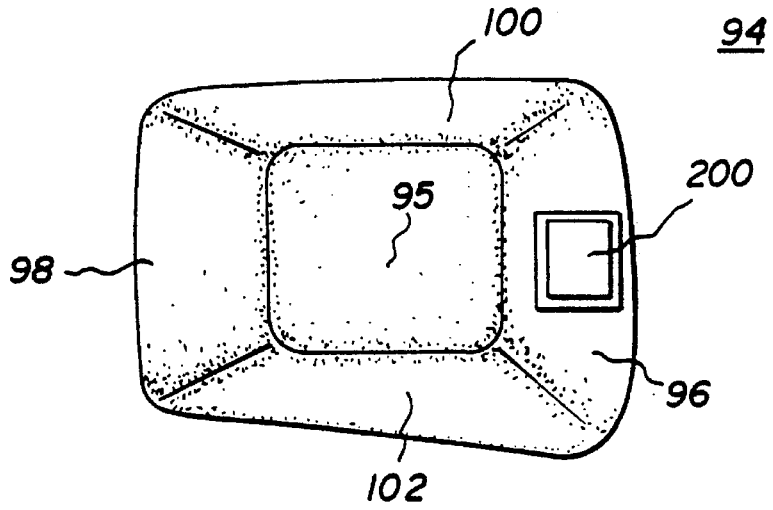
FIG. 5 is a side elevational view of the inverter housing cover unit of FIG. 1.
Figure 6:
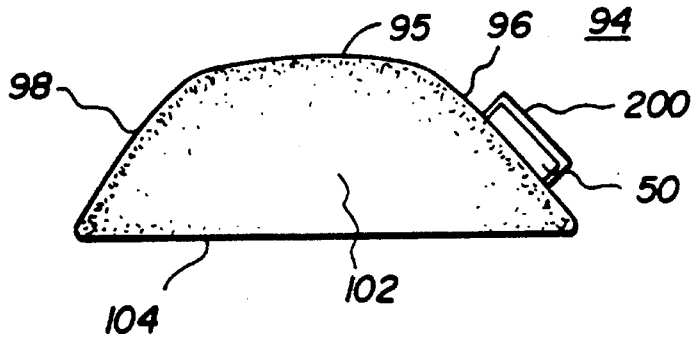
FIG. 6 is a bottom elevational view of the inverter housing cover unit of FIG. 5.
Figure 7:
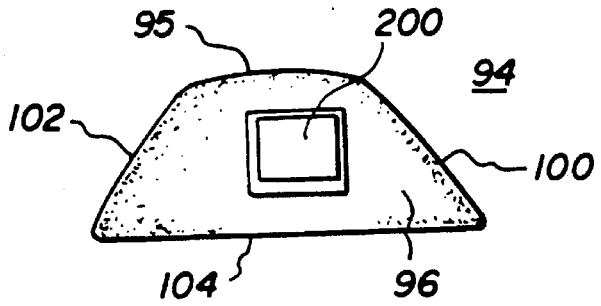
FIG. 7 is a rear elevational view of the inverter housing cover unit of FIG. 5.

As shown in FIG. 1, a bicycle helmet (20) comprises (a) a structural foam liner (22), (b) an electroluminescent lamp film (24), (c) a helmet shell (26), (d) a battery (28) and (e) an inverter (30). The liner (22) (and correspondingly the helmet (20)) preferably has a rear most point (32) and a frontmost point (34) through which a vertical plane (35) (illustrated by dashed lines) would effectively divide the liner (22) (and correspondingly the helmet (20)) into two integral symmetrical halves (36, 38), namely right helmet half (36) and left helmet half (38) (left and right are relative to the left and right hand sides of the wearer of the helmet (20)). Each half (36, 38) has a respective pocket (40, 42), the halves being symmetrical relative to each other about the plane (36), for carrying either the battery (28) or the inverter (30) in a balanced fashion. The symmetrical positioning of the pockets (36, 38) about the vertical plane (35) (and corresponding about a longitudinal axis (44) through points (32, 34) allows for balanced weighting of the inverter (30) and battery (28) thereabout. The battery (28) and inverter (30) are in electrical communication by means for providing electrical communication between the battery (28) and inverter (30), and as illustrated in FIG. 1, suitable means includes a pair of electrically insulated wires (46) and a connector (48). The connector (48) illustrated in FIG. 1 is a conventional connector for a 9 volt battery (28) as also shown in FIG. 1. The pair of wires (housed in an insulative sheathing (46) provides electrical communication between the connector (48) and the inverter (30), and is preferably interrupted by a power switch (50) for turning the power on and off from the battery (28) to the inverter (30). Means for providing electrical communication flow between the inverter (30) and film (24) is provided by a pair of insulated wires (52) which preferably have a connector (54) (female) which connects with a connector (55) (male) of film (24). In operation, the switch (50) is switched to an on position, and direct electrical current flows from battery (28) to inverter (30) which converts the direct current to alternating current, which is then provided in the film (24) for illumination thereof. A wiring groove (56) extends from the right pocket (compartment) (40) to the left pocket (compartment) (42) across the rear (58) of the liner (22). The shell (26) when positioned on the liner (22) will extend down to a shoulder (60). The liner (22) has a rim portion (62) and a dome portion (64), wherein the rim portion (62) extends outwardly beyond the dome portion (64) to form the shoulder (60).

The groove is preferably located in the exterior of the dome (64) and will be overlayed by the film (24). The liner (22) is made from a structural polymeric foam such as expanded polystyrene foam as is commonly used in the bicycle helmet industry. The shell (26) is preferably thermoformed from a clear thermoplastic film such as polycarbonate resin film or polystyrene resin film and is selective painted internally to provide a shell (26) having a transparent window zone (66) and opaque (non transparent) zone (68). As shown in FIG. 1, the transparent window zone (66) can circumscribe the helmet shell (26) and overlay the film (24) to provide the desired light emitting pattern without complex cutting of the film (24). The transparent window zone (66) may be achieved by taping the desired window zone (66) in the concave internal side of the shell (26) and then painting the inside side of the shell (26) with an opaque paint such as a black paint.

The helmet is especially suited for outdoor use by the waterproofing of the pocket (40) containing the battery (28) by utilization of a gasket (70) which is preferably substantially rectangular and annular in shape, and which will provide sealed engagement with a peripheral ledge (72) of pocket (40), and cover unit (74) of pocket (40).

As shown in FIGS. 1, 2, 3 and 4, the power housing cover unit (74) preferably has a shape which will have suitable aerodynamical, structural and aesthetic properties. The cover unit (74) preferably comprises a substantially rectangular lip (76) which extends downwardly from a cap portion (78). The cap portion (78) has an outer ledge (80) which extends outwardly from the lip (76). The ledge (80) is designed for planer sealing engagement of the gasket (70), and the lip (76) is designed for extending into the rectangular pocket cavity (82). The cap portion (76) has a substantially flat rectangular side (84) which is substantially smaller in outer circumference than the ledge (80) of the cover unit (74). Inclined side walls (86, 88, 90, 92) extend inwardly from the outer peripheral of the ledge (80) to the rectangular side (84) to form the cap portion (78). The side (86, 88, 90 and 92) are substantially trapezoidal in shape.

As shown in FIGS. 1, 5, 6 and 7, a power switch cover unit (94) preferably comprises a substantially rectangular top side (95), and inclined sides (96, 98, 100 and 102) extending downwardly and outwardly therefrom. The power switch (50) is preferably attached to and extends through rear side (96) for manual actuation of the light emission of film (24) through window (66) of shell (26). The sides (96, 98, 100 and 102) form an edge (104) opposite the top side (95), and preferably a shelf (106) extended from the portion of edge (104) of rear side (96) frontward a fraction of the distance toward the portion of edge (104) formed by the front side (98).

The electroluminescent lamp film (strip) (24) may be produced by embedding phosphorus in a thin layer of a transparent insulator which is then placed between electrodes for conducting current. The opaque zone (68) effectively blocks light emission therethrough, thereby causing the light emission pattern to be defined by the shape of the transparent window (66). The plastic shell (26) overlays (and is in contact with) the liner (22). The film (24) is located (positioned) between the shell (26) and the liner (22) and is positioned behind the window zone (66) for light emission therethrough. The inverter receives direct current from the battery and converts it to alternating current and supplies the alternating current to the film to cause light to be emitted from the film.

Alternatively, the switch (50) may be housed in a flexible rubber boot (200) to insure the waterproof nature of the power switch. The cover unit (74) preferably is made of a durable thermoplastic and has a biased latch hook (202) which releasably latches (hooks) into receiving slot (204) for releasably holding the cover unit (74) into position over the right pocket (40). The power switch cover unit (94) is preferably permanently adhered in position over the left pocket (42) with the inverter (30) held therein.

I claim:

1. A bicycle helmet comprising:

(a) a structural foam liner, (b) a plastic shell overlaying said liner, said shell comprising an opaque zone and a transparent window zone, (c) an electroluminescent lamp film positioned between said shell and said liner, said film being positioned to emit light through said transparent window zone, (d) an inverter in electrical communication with said film for supplying alternating current from said inverter to said film, (e) a battery in electrical communication with said inverter for supplying direct current from said battery to said inverter.

2. The helmet of claim 1 wherein said liner has a left side comprising a pocket and a right side comprising a pocket, wherein said battery is carried in one of said pockets and said inverter is carried in the other of said pockets.

3. The helmet of claim 2 wherein said liner comprises an upper dome portion and a lower rim portion, said shell overlaying said dome portion, and said pockets being located in said rim portion.

4. The helmet of claim 3 wherein said helmet includes a power switch for controlling the flow of electrical power from said battery to said inverter.

5. The helmet of claim 4 wherein said inverter is carried in the left side pocket and said battery is carried in the right side pocket.

6. The helmet of claim 5 wherein a first cover unit is fixedly attached to said liner over said right side pocket.

7. The helmet of claim 6 wherein a second cover unit is reasonably attached to said liner to permit access to said battery.

* * * * *